US005603192A

United States Patent [19]

Dickson

[11] Patent Number: 5,603,192

[45] Date of Patent: Feb. 18, 1997

[54] OPERABLE WALL PANEL MOUNTING APPARATUS

[75] Inventor: Wesley B. Dickson, Port Townsend, Wash.

[73] Assignee: Advanced Equipment Corporation, Fullerton, Calif.

[21] Appl. No.: 415,647

[22] Filed: Apr. 3, 1995

[51] Int. Cl.[6] ..... E04H 1/00

[52] U.S. Cl. ..... 52/238.1; 52/241; 52/242; 52/235; 52/239

[58] Field of Search ..... 52/238.1, 241, 52/242, 235, 239

[56] References Cited

U.S. PATENT DOCUMENTS

| | | |
|---|---|---|
| 2,278,331 | 3/1942 | Meyercord . |
| 2,816,632 | 12/1957 | Nardulli . |
| 3,170,456 | 2/1965 | Moss et al. . |
| 3,253,552 | 5/1966 | Stein . |
| 3,349,533 | 10/1967 | Gregoire . |
| 3,363,390 | 1/1968 | Crane et al. . |
| 3,399,859 | 9/1968 | Bowden et al. . |
| 3,638,376 | 2/1972 | Howes et al. . |
| 3,680,276 | 8/1972 | Wright et al. . |
| 3,700,385 | 10/1972 | Sherwood . |
| 4,277,920 | 7/1981 | Dixon . |
| 5,063,636 | 11/1991 | Dickson . |

FOREIGN PATENT DOCUMENTS

| | | |
|---|---|---|
| 1400853 | 7/1971 | United Kingdom . |

*Primary Examiner*—Wynn E. Wood
*Attorney, Agent, or Firm*—Price, Gess & Ubell

[57] ABSTRACT

First and second operable wall panel faces are positioned with respect to one another by vertical and horizontal brackets which include corner portions positioning the panel faces in compressed relation with vertical and horizontal flexible vinyl seals extending about the entire perimeter of the panel faces, so as to provide increased impact resistance, reduced noise transmission, and easier manufacture.

14 Claims, 4 Drawing Sheets

OPERABLE WALL PANEL MOUNTING APPARATUS

BACKGROUND OF THE INVENTION

1. Field of the Invention

The subject invention relates to movable partitions, also known as operable walls and, more particularly, to improved operable wall panel mounting apparatus providing resiliently mounted wall panel faces.

2. Description of Related Art

Operable wall systems have been frequently employed to divide large spaces such as convention centers, ballrooms, school classrooms, and gymnasiums. Such walls are often subject to impacts typically encountered by the interior walls of any structure. Such walls are typically not as thick as fixed walls and may not provide adequate sound insulation or the desired impact resistance in some applications. Thus, there exists a need to increase the impact resistance of operable walls systems and to reduce the noise or sound transmission capabilities of such walls.

OBJECTS AND SUMMARY OF THE INVENTION

It is therefore an object of the invention to improve operable wall systems;

It is another object of the invention to increase the impact resistance of wall panels in such systems;

It is another object of the invention to increase the resistance of such systems to transmission of sound through the panel walls; and It is yet another object of the invention to provide operable wall apparatus with improved impact resistance and improved acoustical properties which is convenient to use and relatively cost-effective to manufacture.

According to the invention, the operable wall panels are mounted by a mounting mechanism employing flexible seals around the entire periphery of each panel of an operable wall panel pair. The seals provide impact resistance and acoustic sealing, while providing the added advantage of reducing manufacturing tolerances.

BRIEF DESCRIPTION OF THE DRAWINGS

The objects and features of the present invention, which are believed to be novel, are set forth with particularity in the appended claims. The present invention, both as to its organization and manner of operation, together with further objects and advantages, may best be understood by reference to the following description, taken in connection with the accompanying drawings.

DETAILED DESCRIPTION OF THE PREFERRED EMBODIMENTS

The following description is provided to enable any person skilled in the art to make and use the invention and sets forth the best modes contemplated by the inventor of carrying out his invention. Various modifications, however, will remain readily apparent to those skilled in the art, since the generic principles of the present invention have been defined herein specifically to provide easily operated and conveniently manufactured operable wall apparatus with improved impact resistance and acoustical properties.

Figure 1:
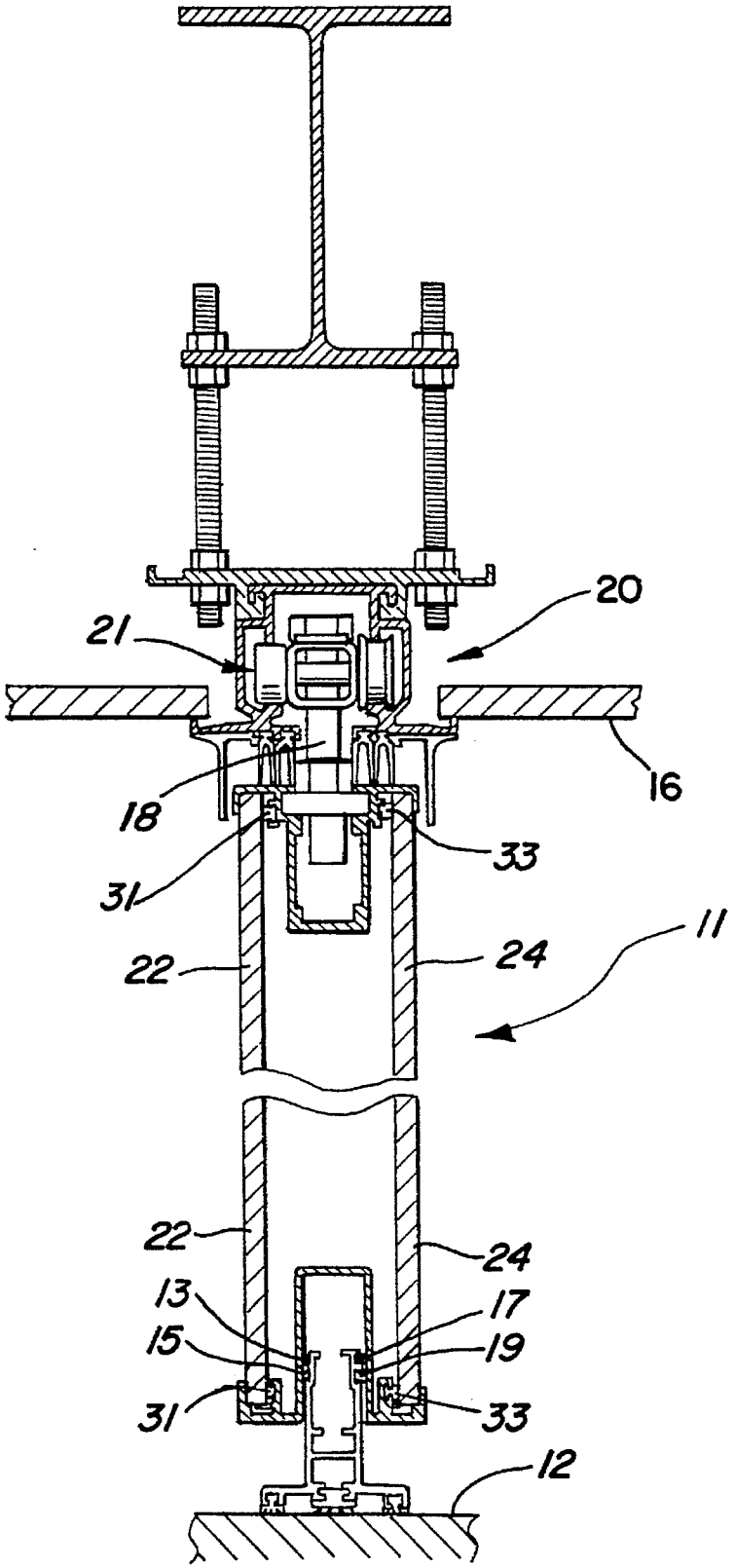
FIG. 1 is a side cross-sectional view of an operable wall system wherein the preferred embodiment finds application.
Figure 2:
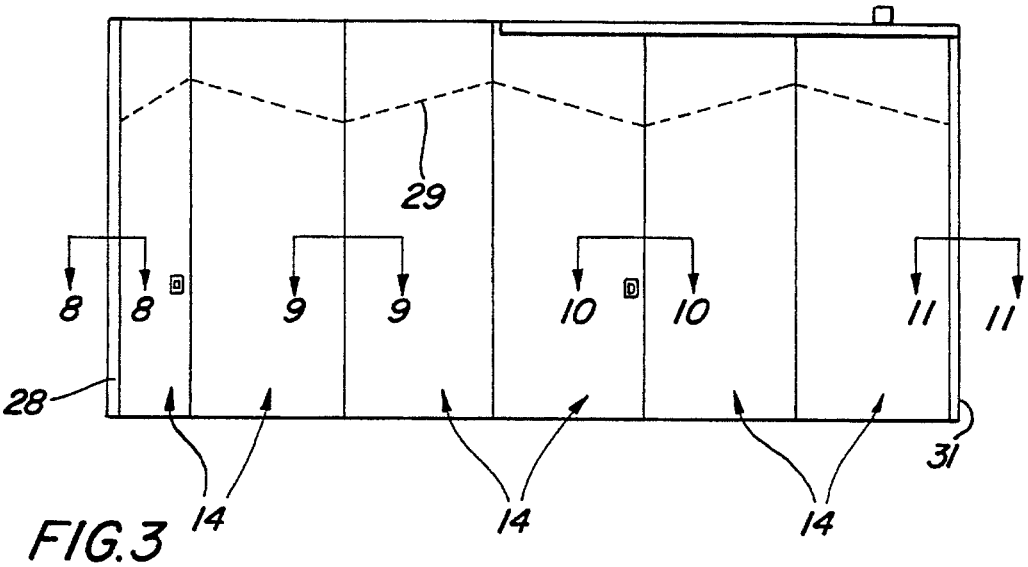
FIG. 2 is an elevational view illustrating an operable wall system wherein the preferred embodiment finds application.

Referring now specifically FIGS. 1 and 2 of the drawings, a portable wall system 11 wherein one embodiment of the present invention finds application is shown as including a plurality of portable wall panels 14 arranged in vertical orientation and horizontal alignment to form a portable wall between a floor surface 12 and a ceiling surface 16 in order to provide a portable wall, partition, or the like, in an enclosed space such as a convention center, hotel ballroom, or the like so that the enclosed space may be divided into smaller enclosed spaces for various purposes. The wall panels 14 are constructed of any desired standard size modules and may be of various heights for installation in spaces having different height or width dimensional characteristics.

The wall 11 generally includes wall panels 14, which may be suspended from the ceiling by a guide track mechanism 20 employing trolleys 21 connected to the panel 14 by dependent bolts 18. FIG. 2 generally illustrates six panels 14, one of the panels 14 being one-half the width of the other five and hinged to a wall 28. These panels are suspended by a typical trolley mechanism and foldable along a pattern indicated by dashed line 29.

Each wall panel 14 includes a pair of planar panel members 22 and 24 disposed in spaced, generally parallel relation to each other. The panel members 22 and 24 are secured to a peripheral frame generally in the form of a channel-shaped extrusion or the like, as illustrated in more detail hereinafter. The panel members 22 and 24 may be constructed of wood, plastic, metal, or any other material used in constructing walls and wall panels and provided with any external ornamentation or appearance characteristics, as desired. Various types of wall boards, laminated panels, flake board, or the like, may be used liar this purpose with insulating material therebetween, if desired. The overall thickness of the panel 14 may be varied, as desired, so that the physical characteristics of the panels 14 will be compatible with the enclosed space in which the panels are used and capable of being moved to a desired location and handled by individuals.

Figure 3:
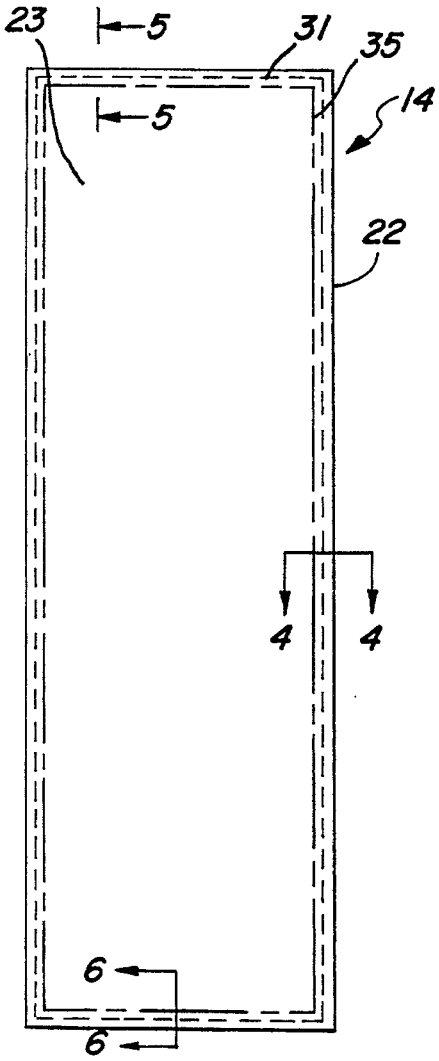
FIG. 3 is an elevation of an operable wall panel according to the preferred embodiment.

FIG. 3 further illustrates a wall panel 14 having a rectangular flexible vinyl seal 31 placed adjacent and about the entire perimeter 35 of the inner surface 23 of the wall panel 22. The vinyl seal could be a continuous seal element in alternate embodiments, but is preferably segmented into sections, horizontal and vertical sections being employed in that illustrative embodiment under discussion.

Figure 4:
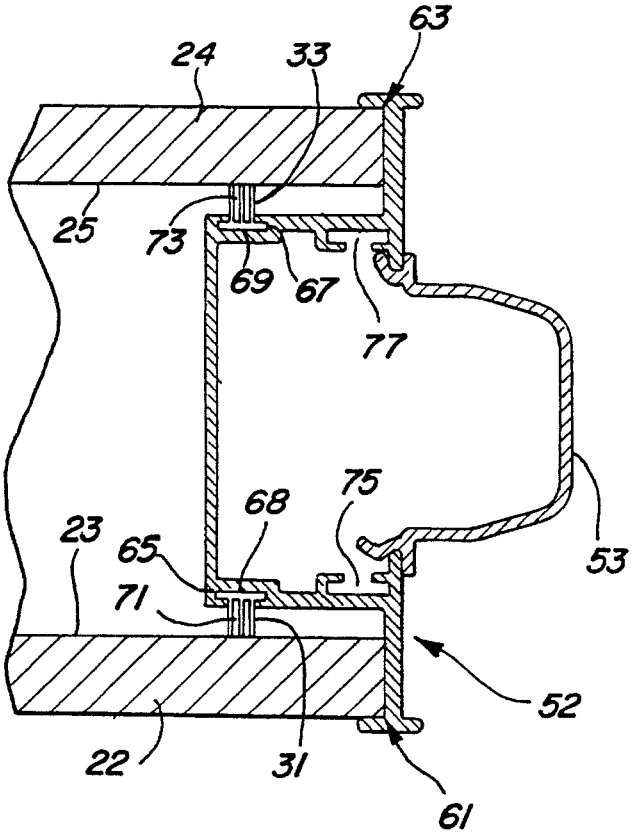
FIG. 4 is a cross-sectional view taken at 4—4 of FIG. 3.

FIG. 4 illustrates a vertical seal positioning bracket extrusion or "stile" 52 and an extruded male edge piece 53. The stile bracket 52 provides respective corners 61, 63 for receiving the corners of the sides of the panel faces 22, 24, and further provides first and second seal-receiving channels 65, 67 shaped in cross-section to receive the generally cross-sectionally rectangular heads 68, 69 of the T-shaped flexible vinyl seal members 31, 33. The stile bracket 52 thereby positions the stems 71, 73 of the seal members 31, 33 in slightly compressed abutting relation with the inner surfaces 23, 25 of the panel faces 22, 24. The stile bracket 52 further includes third and fourth seal-receiving channels 75, 77, for receiving and retaining vinyl seals 141, as shown in connection with FIGS. 8–10 described in further detail hereafter. The male edge piece 53 is preferably fabricated of extruded aluminum, as is the bracket 52. The male edge piece 53 slips inside the stile piece of a mating panel section 14, as further illustrated and described in connection with FIGS. 8–10.

Figure 5:
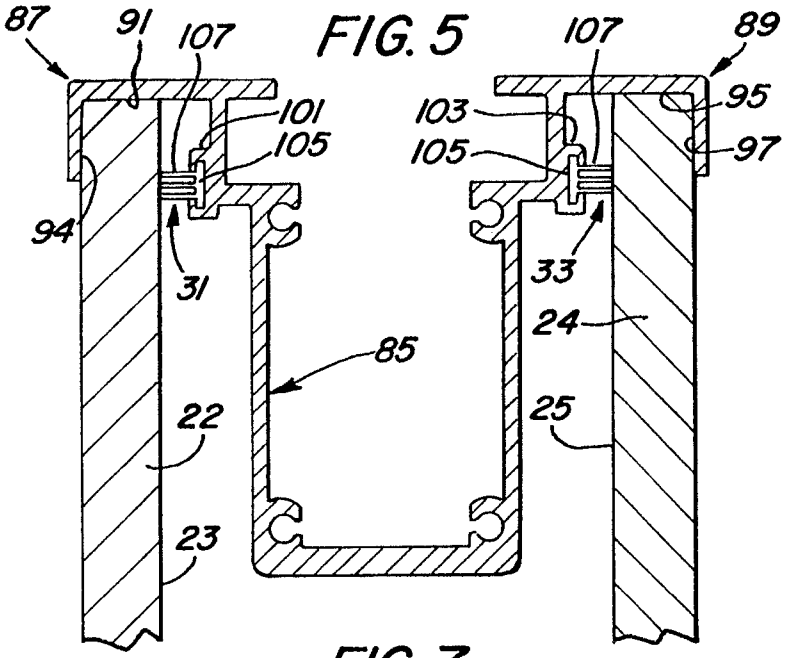
FIG. 5 is a cross-sectional view taken at 5—5 of FIG. 3.

As shown in FIG. 5, a horizontal seal-positioning bracket 85 is structured to further position the panel 22 and the flexible vinyl seal 31 with respect to one another, and to further hold the seal 31 in a slightly compressed, sealing relation with the inner panel face 23. The bracket 85 is preferably a single-piece, metal extrusion and includes first and second clamp portions 87, 89 providing respective horizontal wall surfaces 91, 95 and respective vertical wall surfaces 97, 94, which meet to define right-angle corners which receive the corners of the respective panel faces 22, 24. Below each clamp portion 87, 88 are located mounting channels 101, 103 shaped in cross-section to receive the heads 105 of the T-shaped flexible vinyl seals 31, 33 and to thereby position the stems or sealing portions 107 of the seals 31, 33 to abut the inner surfaces 23, 25 of the respective panels 22, 24. The T-shaped flexible vinyl seals 31, 33 could be variously fabricated but, as shown in the drawings, include three parallel fins extending from the head portions 105.

Figure 7:
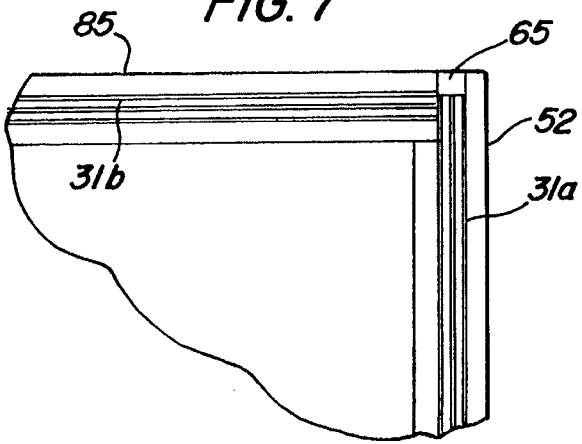
FIG. 7 is a detail corner structure of the operable wall panel of FIG. 1.

Each vinyl seal 31, 33 may comprise two horizontal and two vertical seal strips whose respective ends are slid into the mounting channels, e.g., 65, 67; 101, 103 of respective upper horizontal, lower horizontal, and right and left vertical bracket extrusions. Such structure is further illustrated in FIG. 7, which shows vertical seal strip 31*a* meeting and abutting the end of a horizontal seal strip 31*b* at the corner-intersection of a right vertical extrusion 52 and an upper horizontal extrusion 85.

Figure 6:
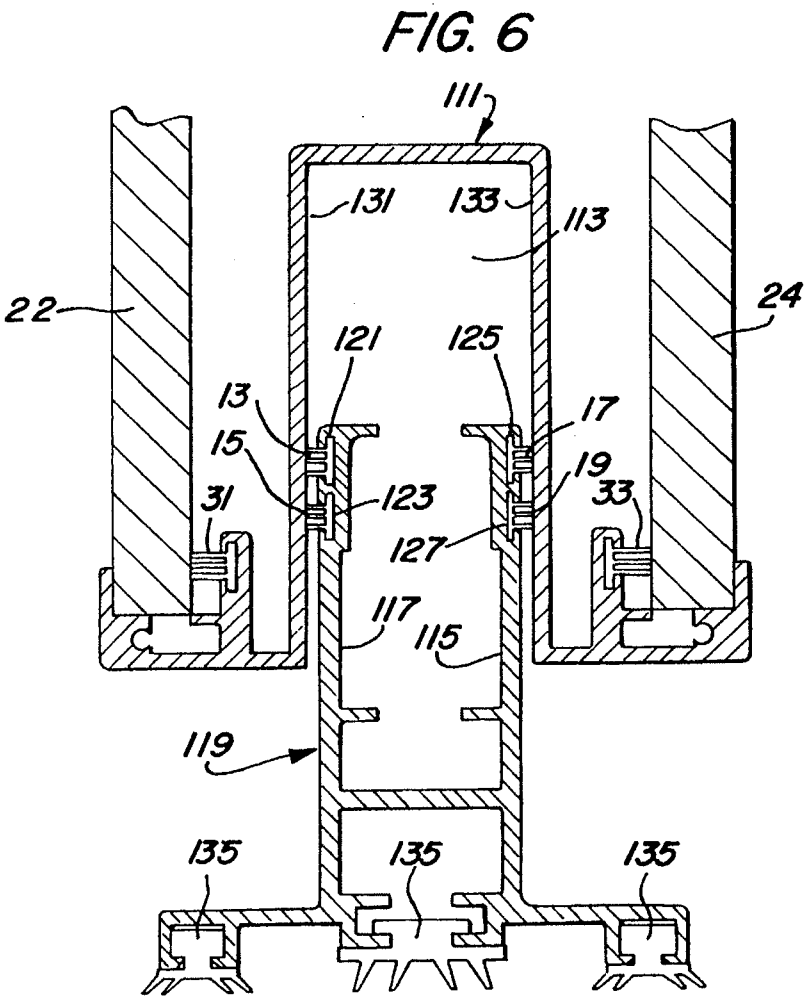
FIG. 6 is a cross-sectional view taken at 6—6 of FIG. 3.

FIG. 6 further illustrates a lower horizontal or bottom channel or bracket 111, which again may be extruded aluminum. The channel 111 defines a generally rectangular chamber 113, which receives first and second sides 115, 117 of a bottom seal bar 119. The first and second sides of the bottom seal bar include respective pairs of channels 121, 123; 125, 127 mounting flexible vinyl seals 13, 15, 17, 19 so as to sealingly abut the inner walls 131, 133 of the chamber 113 provided by the bottom channel 119. The extruded aluminum seal bar 119 may be adapted to be raised or lowered such that vinyl bottom seals 135 engage the floor surface, for example, as taught in U.S. patent application Ser. No. 08/159,037, entitled "Lateral Load Transfer System for Operable Walls, assigned to the present assignee and herein incorporated by reference.

Figure 10:
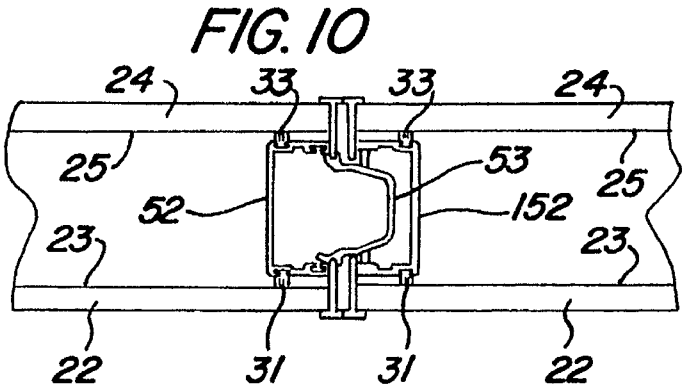
FIGS. 8–11 are partial sectional views taken, respectively, at 8—8, 9—9, 10—10, and 11—11 of FIG. 2.
Figure 11:
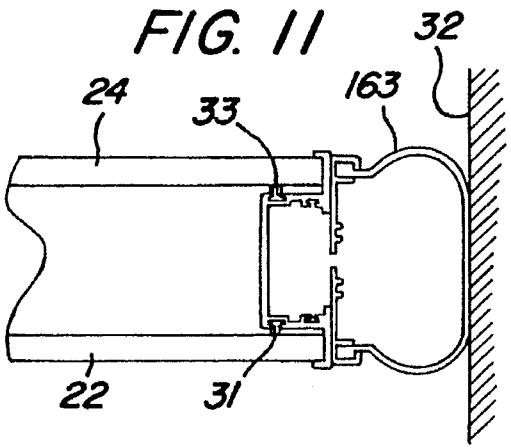
Figure 8:
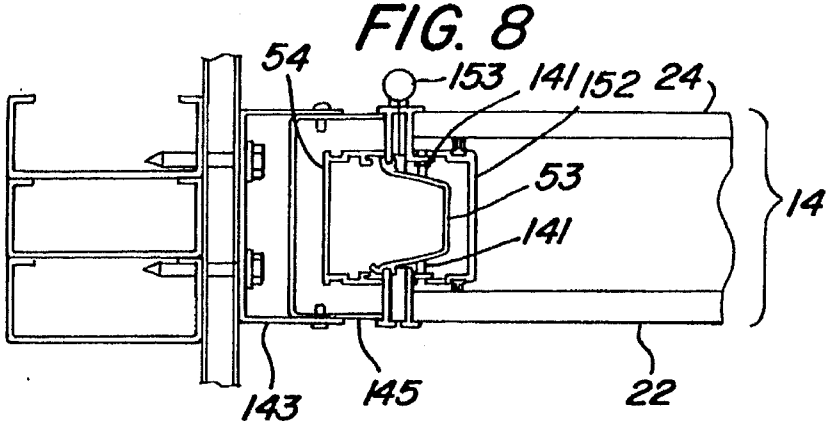
Figure 9:
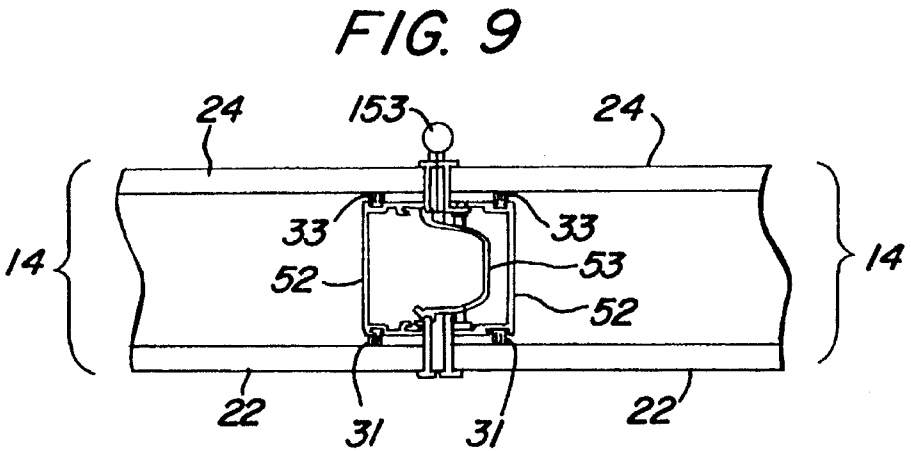

FIG. 8 illustrates a typical hinge jamb construction according to the preferred embodiment. A jamb buck 143 mounts a jamb member 145, which further mounts a vertical bracket 54 and interlocking male edge 53, constructed according to the teachings above. The male edge 53 slips inside a stile piece 52, which is preferably an inverted extrusion 52 with vinyl seals 141 inserted in slots 75, 77 (FIG. 4) so as to sealingly abut the sides of the male edge extrusion 53. Wall panels 22, 24 are further positioned to sealingly abut vinyl seals 31, 33 mounted by a stile piece 152, again constructed according to the teachings above. As further shown in FIG. 8, the panel 14 is hinged to the jamb 145 by a hinge 153. As shown in FIGS. 9 and 10, the mating extrusion and seal structure illustrated in FIG. 8 is employed at hinged and unhinged intersections of mating wall panels 14, with the addition of seals 31, 33 provided in the vertical extrusion member 52. As shown in FIG. 11, an end structure employing a bulb seal 163 is employed to interface with the far wall 32. Again, a suitable vertical end extrusion positions seals 31, 33 in sealing relation against the wall panels 22, 24.

Those skilled in the art will appreciate that various adaptations and modifications of the just-described preferred embodiment can be configured without departing from the scope and spirit of the invention. Therefore, it is to be understood that, within the scope of the appended claims, the invention may be practiced other than as specifically described herein.

What is claimed is:

1. Operable wall apparatus comprising:

first and second wall panels;

first and second clamp means for mounting adjacent a respective edge of an outer surface of said first and second wall panels;

first and second flexible seal means for mounting adjacent a respective inner surface of said first and second wall panels; and bracket means for fixing said panels in position with respect to one another to form an operable wall and for holding each of said first and second clamp means in clamping relation with its respective outer surface edges of the wall panels and for holding each of said first and second seal means in sealing relation with respective inner surfaces of the wall panels surface.

2. The apparatus of claim 1 wherein said bracket means comprises a bracket having corner portions comprising clamping means for retaining outer surface edges of the wall panels and mounting channel means for mounting said flexible seal means.

3. The operable wall apparatus of claim 2 wherein said first and second flexible seal means further provide a rectangular-shaped seal.

4. The apparatus of claim 3 wherein said flexible seal means comprises first and second flexible vinyl seal structures.

5. The apparatus of claim 1 wherein said bracket means comprises a bracket having a first corner portion for retaining said first wall panel face and a mounting channel means for mounting said flexible seal means.

6. The apparatus of claim 5 wherein said seal means comprises T-shaped flexible vinyl seals slidingly insertable into said mounting channel means.

7. The apparatus of claim 4 wherein said bracket means comprises a bracket having corner portions comprising clamping means for retaining outer surface edges of the wall panels and mounting channel means for mounting said flexible seal means.

8. The apparatus of claim 1 wherein said bracket means includes a first vertical bracket extrusion having first and second vertical corner portions for respectively retaining said first and second wall panels and first and second channel means for mounting said flexible seal means.

9. The apparatus of claim 8 wherein said flexible seal means includes first and second vertical seal strips slidingly insertable into said mounting channel means.

10. The apparatus of claim 8 wherein vertical bracket extrusion further includes third and fourth channel means, each for mounting a third and fourth vertical seal means.

11. The apparatus of claim 10 wherein said bracket extrusion has an interior and exterior surface, said exterior surface defining an opening for receiving a cooperating male stile portion, and wherein said first and second channel means are located on said interior surface and said third and fourth channel means are located on said exterior surface for positioning respective third and fourth seal means to sealing abut a said male stile portion.

12. The apparatus of claim 8 wherein said bracket means further includes a horizontal bracket extrusion having first and second horizontal corner portions for respectively retaining said first and second wall panels and first and second horizontal channel means for mounting said flexible seal means.

13. The apparatus of claim 12 wherein said bracket means further includes an extruded horizontal bottom channel means having first and second bottom corners for retaining said first and second panels and first and second bottom channels for mounting said flexible seal means.

14. The apparatus of claim 13 wherein said bottom channel further includes a chamber means for receiving an extruded aluminum seal bar.

* * * * *